US010352584B2

(12) United States Patent
Huang et al.

(10) Patent No.: US 10,352,584 B2
(45) Date of Patent: Jul. 16, 2019

(54) VENTILATION FAN

(71) Applicant: DELTA ELECTRONICS, INC., Taoyuan Hsien (TW)

(72) Inventors: Yu-Hsiang Huang, Taoyuan Hsien (TW); Kuan-Chung Cheng, Taoyuan Hsien (TW); Chih-Hua Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 948 days.

(21) Appl. No.: 14/565,974

(22) Filed: Dec. 10, 2014

(65) Prior Publication Data

US 2015/0159910 A1 Jun. 11, 2015

(30) Foreign Application Priority Data

Dec. 10, 2013 (TW) ..... 102145293 A

(51) Int. Cl.
*F24F 13/28* (2006.01)
*F24F 7/007* (2006.01)

(52) U.S. Cl.
CPC ..... *F24F 13/28* (2013.01); *F24F 7/007* (2013.01)

(58) Field of Classification Search
CPC ..... F04D 25/08; F04D 25/10; F04D 25/12; F04D 25/14; F24F 7/007; F24F 7/10; F24F 1/027; F24F 13/28; F24F 2221/14
USPC ..... 454/243, 248, 349, 354
See application file for complete search history.

(56) References Cited

U.S. PATENT DOCUMENTS 6,149,698 A * 11/2000 Uehara ..... F24F 7/013 454/351
6,488,578 B1 * 12/2002 Kuo ..... F24F 13/072 454/245
2009/0004966 A1 * 1/2009 Su ..... F24F 7/065 454/346
2012/0087128 A1 * 4/2012 Zakula ..... F21V 33/0088 362/249.02

FOREIGN PATENT DOCUMENTS

| | | | |
|---|---|---|---|
| CN | 101210569 | A | 7/2008 |
| JP | 2008032340 | A | 2/2008 |
| JP | 2011144987 | A | 7/2011 |
| JP | 2013178000 | A | 9/2013 |
| KR | 20060111999 | A | 10/2006 |
| TW | 201239287 | A | 10/2012 |

* cited by examiner

*Primary Examiner* — Jason D Shanske
*Assistant Examiner* — Julian B Getachew
(74) *Attorney, Agent, or Firm* — Muncy, Geissler, Olds & Lowe, P.C.

(57) ABSTRACT

A ventilation fan comprises a fan, a cover module and a filter. The fan includes an inlet and an outlet. The cover module is disposed at the inlet and includes a main body and a cover. The main body includes an opening and fixing portions. The opening is disposed corresponding to the inlet. The periphery of the opening is configured with two opposite slideways. The fixing portions are disposed on the main body. The cover and the main body are disposed separately to form a gap and the cover includes connecting portions correspondingly connected to the fixing portions. The filter detachably slides on the slideways to be disposed at the opening. The size of the cover is larger than that of the opening. The air flows to the filter and inlet through the gap and flows out of the outlet through the fan.

18 Claims, 9 Drawing Sheets

VENTILATION FAN

CROSS REFERENCE TO RELATED APPLICATIONS

This Non-provisional application claims priority under 35 U.S.C. § 119(a) on Patent Application No(s). 102145293 filed in Taiwan, Republic of China on Dec. 10, 2013, the entire contents of which are hereby incorporated by reference.

BACKGROUND OF THE INVENTION

Field of Invention

The invention relates to a ventilation fan.

Related Art

With the progress of technologies, people place more importance on the life quality than before, especially on the air quality and human health. However, for the sake of blocking the outdoor noise and heat and remaining the indoor temperature, the buildings are usually constructed by special materials to create unventilated rooms. Accordingly, the ventilation is insufficient and the harmful contaminations can't be exhausted.

Therefore, it is an important subject to provide a ventilation fan which can keep the indoor ventilation.

SUMMARY OF THE INVENTION

In view of the foregoing subject, an objective of this invention is to provide a ventilation fan which can keep the indoor ventilation.

To achieve the above objective, a ventilation fan according to the invention comprises a fan, a cover module and a filter. The fan includes an inlet and an outlet. The cover module is disposed at the inlet and includes a main body and a cover. The main body includes an opening and a plurality of fixing portions. The opening is disposed corresponding to the inlet. The periphery of the opening is configured with two opposite slideways. The fixing portions are disposed on the main body. The cover and the main body are disposed separately to form a gap and the cover includes a plurality of connecting portions correspondingly connected to the fixing portions. The filter detachably slides on the slideways to be disposed at the opening. The size of the cover is larger than that of the opening. The air flows to the filter and the inlet through the gap and then flows out of the outlet through the fan.

In one embodiment, the distance of the gap is between 5 mm and 30 mm.

In one embodiment, the cover further includes a blocking wall disposed around the surface of the cover facing the main body.

In one embodiment, the height of the blocking wall is greater than 2 mm.

In one embodiment, the cover further includes a plurality of depressions and/or blind holes which are disposed on the surface of the cover facing the main body.

In one embodiment, the average distance from the projection location of the edge of the cover on the main body to the opening is greater than or equal to the distance of the gap.

In one embodiment, the main body includes at least a first positioning portion and the filter includes at least a second positioning portion, and the first positioning portion and the second positioning portion are disposed correspondingly.

In one embodiment, the filter includes two second positioning portions which are disposed on the two sides of the filter respectively.

In one embodiment, the ventilation fan further comprises at least a fixing element. The cover module is connected to the fan by the fixing element. The fixing element is an elastic element.

As mentioned above, the ventilation fan of this invention can provide the ventilation for the room, and the cover and the main body are separately disposed to form the gap for the side suction of the air. Accordingly, the air will flow to the filter and inlet through the gap and then flow out of the outlet through the fan, so that the dust won't be accumulated on the cover. Besides, due to the detachable design of the filter and cover module, the user can replace the filter without additionally opening the cover, so that the clean operation for the filter becomes easier and more convenient.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
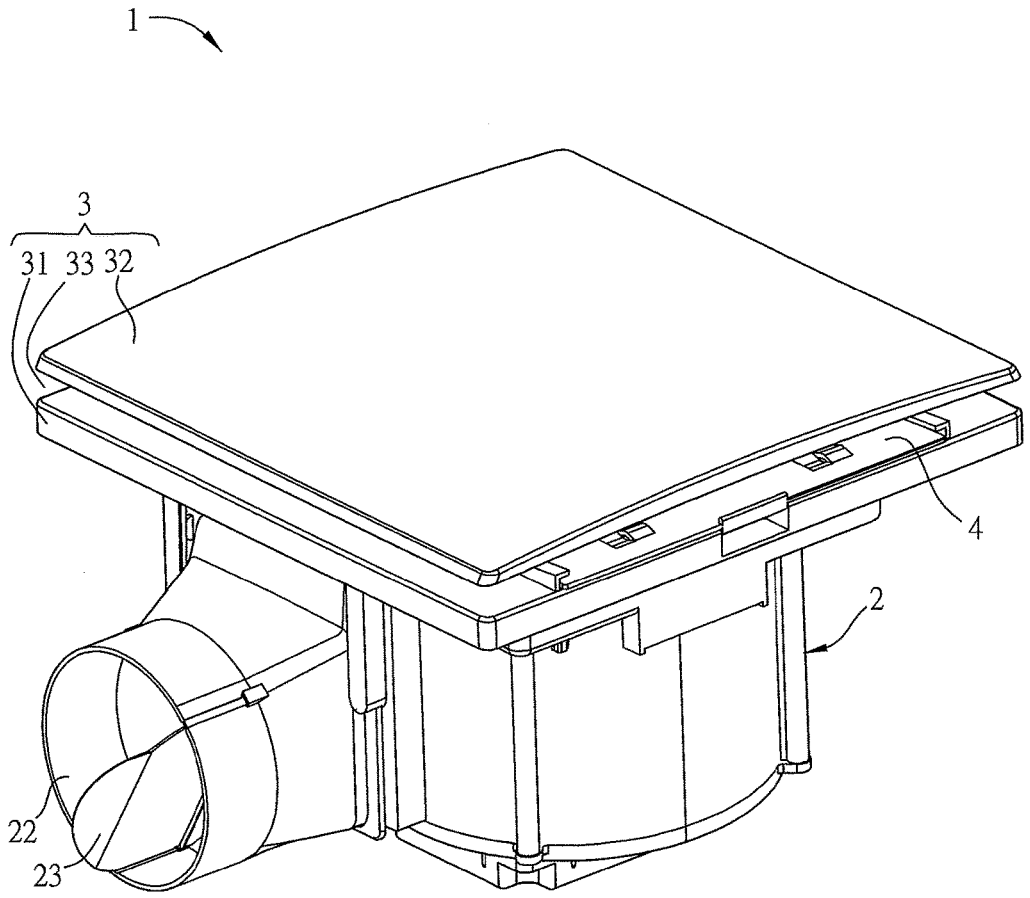
FIG. 1A is a schematic diagram of a ventilation fan of an embodiment of the invention.
Figure 1B:
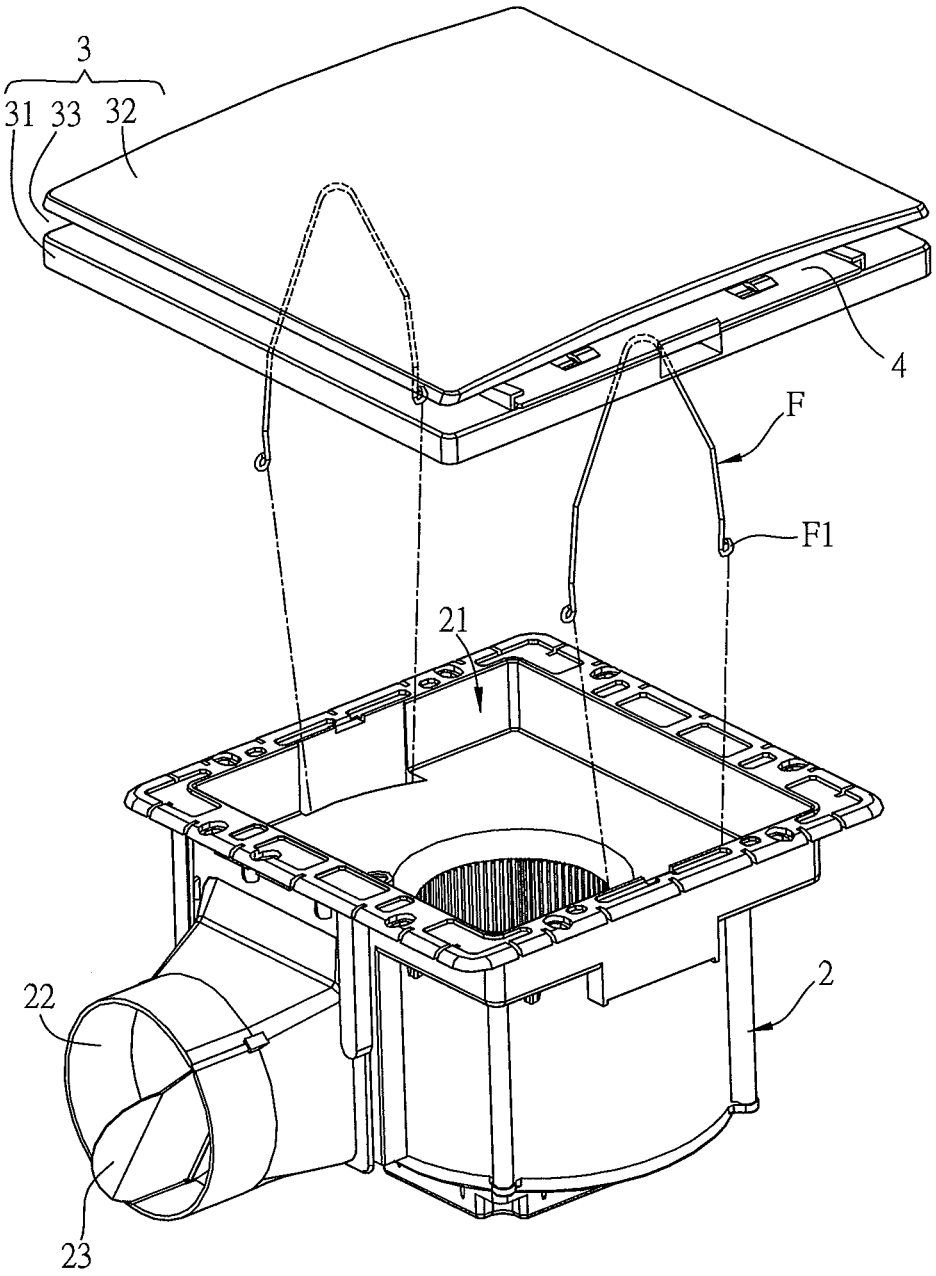
FIG. 1B is a schematic diagram of the assembly of the ventilation fan in FIG. 1A.

FIG. 1A is a schematic diagram of a ventilation fan of an embodiment of the invention, and FIG. 1B is a schematic diagram of the assembly of the ventilation fan in FIG. 1A. As shown in FIGS. 1A and 1B, the ventilation fan 1 includes a fan 2, a cover module 3 and a filter 4. The material of the filter 4 is not shown in the figures to clearly illustrate the structure of the ventilation fan 1. The ventilation fan 1 of this embodiment is disposed in a room, such as a bedroom, bathroom, toilet or kitchen, for discharging the indoor air to the outside to facilitate the indoor ventilation and keep the airflow. In practice, the ventilation fan 1 is installed to a ceiling interlayer and the cover module 3 is disposed to face the ground.

The fan 2 includes an inlet 21 and an outlet 22. In this embodiment, the fan 2 further includes a motor and a blade (not shown). The motor connects to and drives the blade to rotate, so that the air is sucked in through the inlet 21 and then discharged out through the outlet 22. In this embodiment, the outlet 22 is configured with a blocking plate 23, which is disposed pivotally at the vicinity of the outlet 22. When the ventilation fan 1 works, the air will flow from the inlet 21 to the outlet 22 and then push the blocking plate 23 away to flow out. When the ventilation fan 1 doesn't work, the blocking plate 23 will close the outlet 22 to avoid the backflow.

Figure 2A:
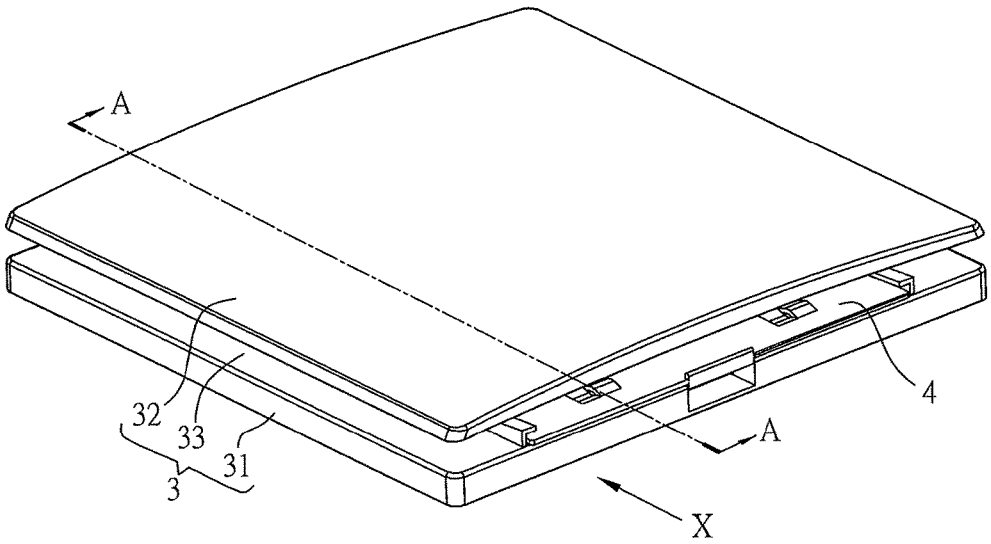
FIG. 2A is a schematic diagram of the cover module and the filter.
Figure 2B:
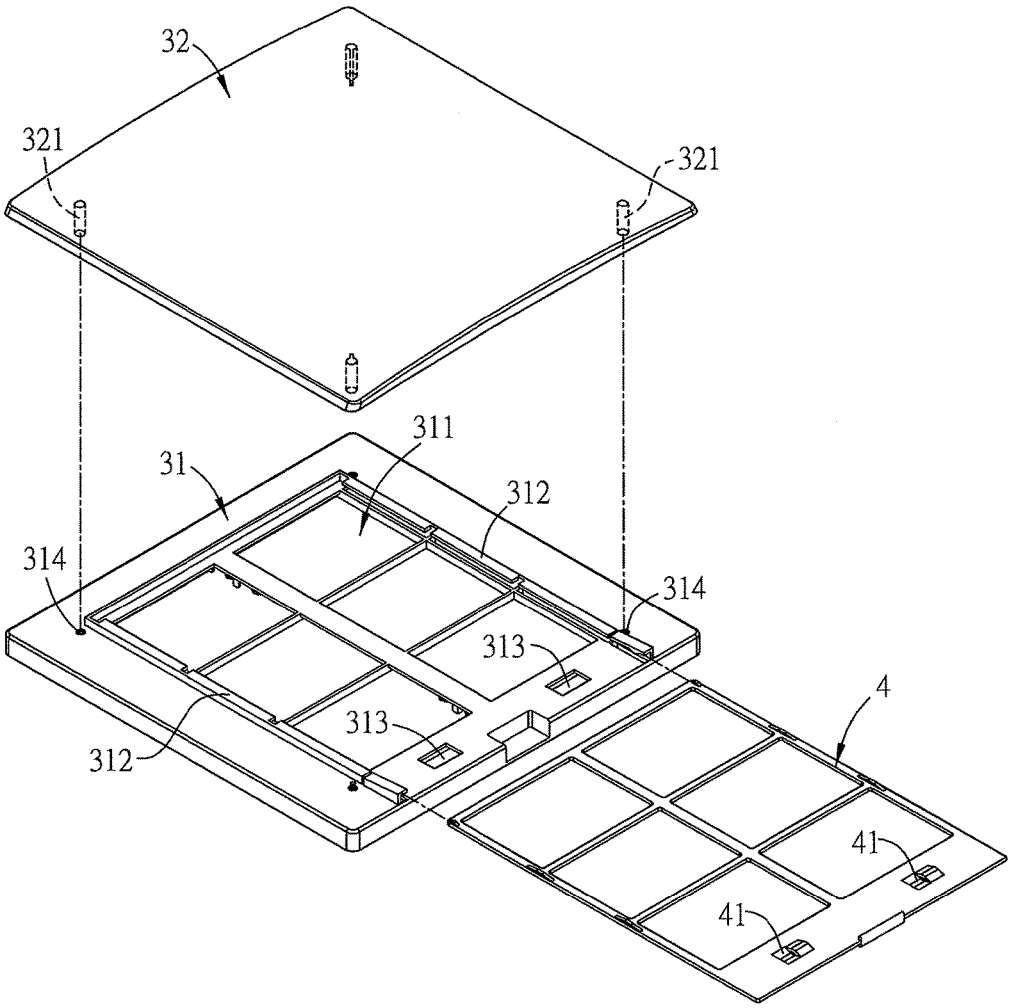
FIG. 2B is a schematic exploded diagram of the cover module and the filter.

FIG. 2A is a schematic diagram of the cover module 3 and the filter 4, and FIG. 2B is a schematic exploded diagram of the cover module 3 and the filter 4. As shown in FIGS. 2A and 2B, the cover module 3 is disposed at the inlet 21 of the fan 2 and includes a main body 31 and a cover 32. The cover 32 and the main body 31 are disposed separately to form a gap 33. The main body 31 includes an opening 311 and the size of the cover 32 is larger than that of the opening 311. The relative position of the opening 311 and inlet 21 is as shown as FIG. 1B. In this embodiment, the opening 311 is divided into a plurality of sub-openings by ribs, but this invention is not limited thereto. The ribs can assist in the structural strength and fix the filter 4 during the operation of the ventilation fan 1. Herein, when the ventilation fan 1 works, the air flows to the filter 4 and the inlet 21 through the gap 33 and then flows out of the outlet 22 through the fan 2. In other words, when the ventilation fan 1 is installed to the ceiling horizontally, the air is sucked in through the gap 33 in a lateral direction instead of a vertical direction, and therefore the dust can be prevented from accumulating on the cover 32.

Figure 3:
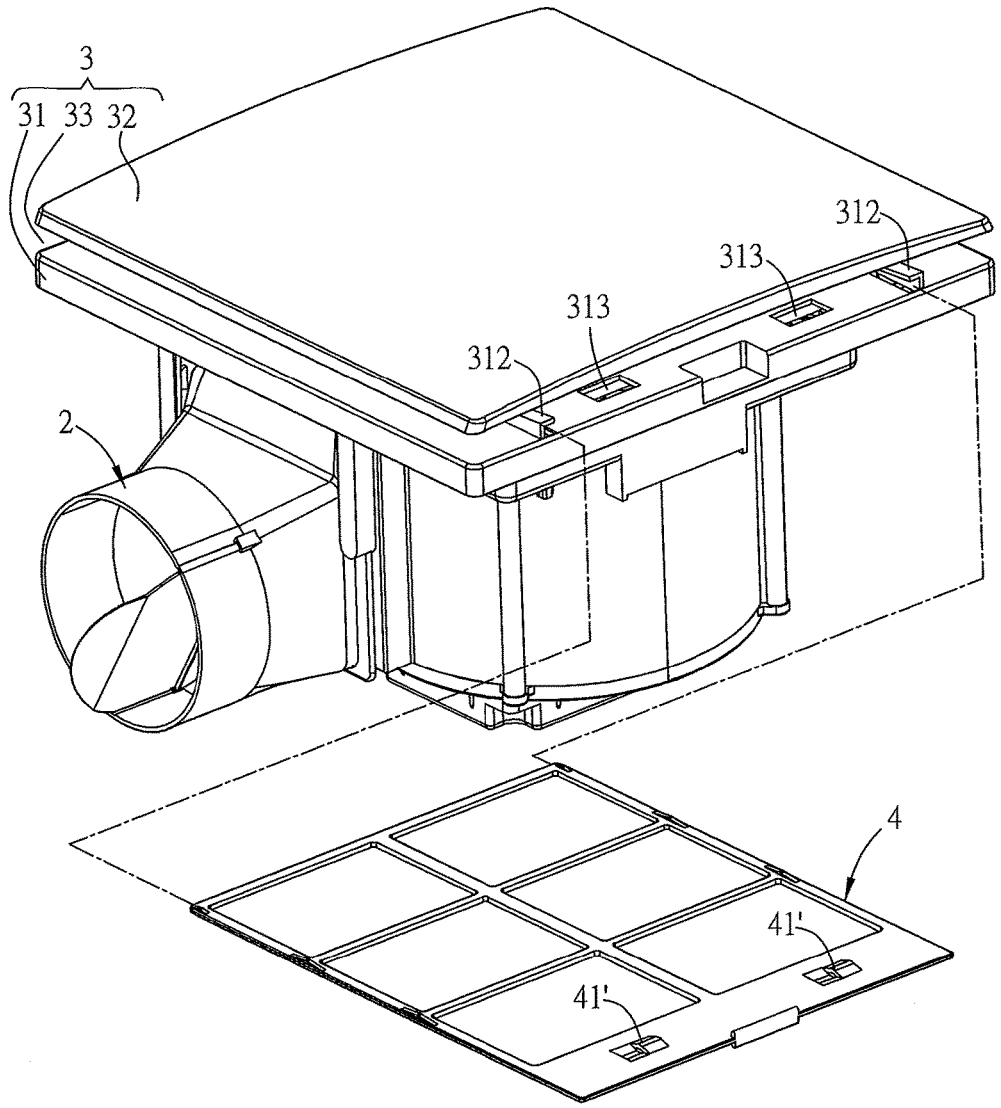
FIG. 3 is a schematic diagram of the assembly of the filter.

Moreover, the periphery of the opening 311 is configured with two opposite slideways 312. The filter 4 can detachably slide on the slideways 312 to be disposed at the opening 311 in order to assist the user in removing the filter 4 for the clean or replacement. As shown in FIG. 3, by the filter 4 slideable on the main body 31 and the gap design between the main body 31 and the cover 32, the user can remove the filter 4 without opening or dismount the main body 31. Therefore, the operation of cleaning the filter 4 will become easier and more convenient.

Figure 4A:
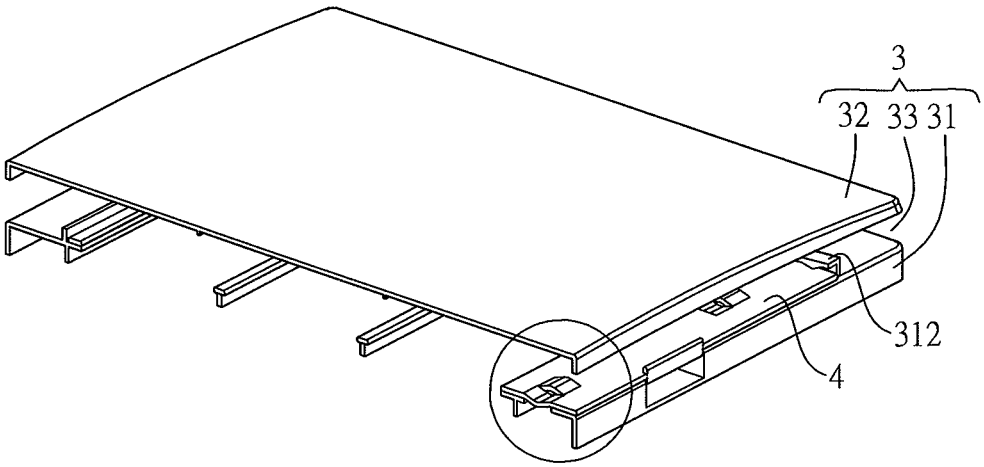
FIG. 4A is a schematic sectional diagram taken along the line A-A in FIG. 2A.
Figure 4B:
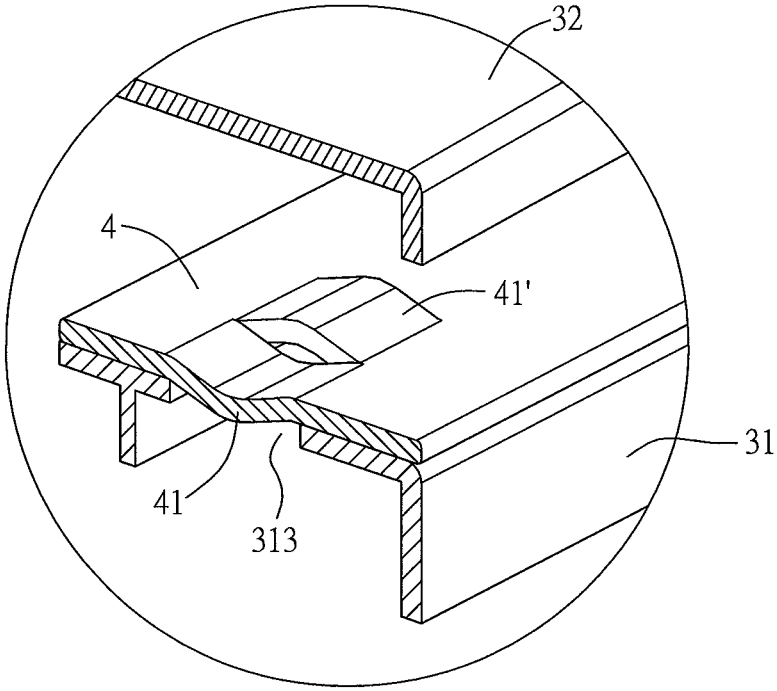
FIG. 4B is a schematic enlarged diagram of a part in FIG. 4A.
Figure 4C:
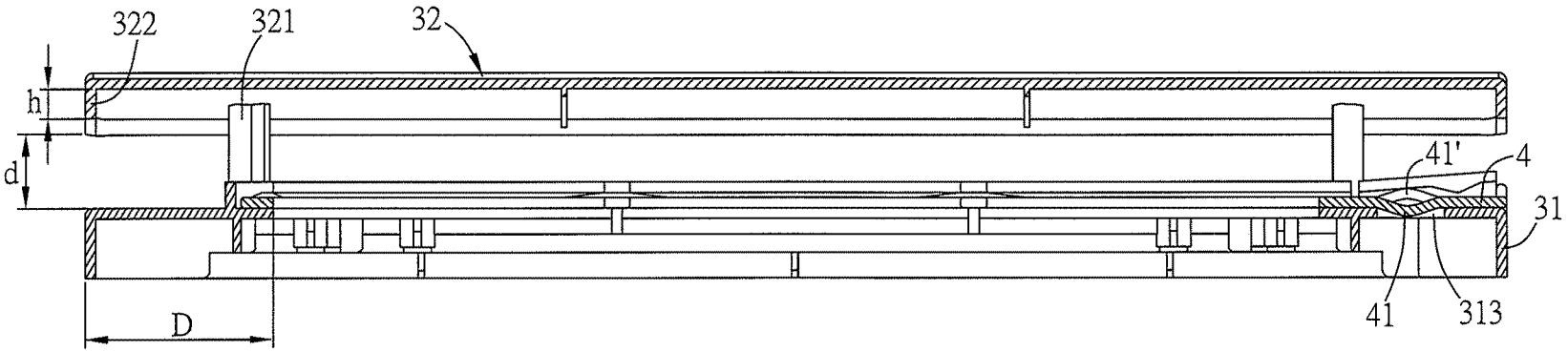
FIG. 4C is a schematic sectional diagram taken along the line A-A in FIG. 2A.

FIGS. 4A and 4C are schematic sectional diagrams taken along the line A-A in FIG. 2A, and FIG. 4B is a schematic enlarged diagram of a part in FIG. 4A. As shown in FIGS. 2B, 3, 4A to 4C, the main body 31 can include at least a first positioning portion 313 and the filter 4 can include at least a second positioning portion 41. The first positioning portion 313 and the second positioning portion 41 are disposed correspondingly and can engage with each other. By the above positioning method, when the filter 4 is pushed to the end along the slideways 312, the filter 4 won't come off the slideways 312 due to the match of the first positioning portion 313 and second positioning portion 41. In this embodiment, two first positioning portions 313 and two second positioning portions 41 are given as an example, but one or more first positioning portions 313 and second poisoning portions 41 can be used in other embodiments, as long as they can reliably position the filter 4.

As shown in FIGS. 4A and 4B, the first positioning portion 313 of this embodiment is embodied as an opening or hole, such as a through opening or hole or a blind opening or hole. In this embodiment, the second positioning portion 41 is embodied as a protrusion to match the first positioning portion 313 for achieving the positioning function. To be noted, the second positioning portion 41 of the filter 4 of this embodiment can be designed in a double-sided manner. For example, as shown in FIG. 4B, the filter 4 includes two second positioning portions 41 and 41'. The second positioning portion 41 protrudes downward to engage with the first positioning portion 313, and the second positioning portion 41' that protrudes upward is disposed adjacent to the second positioning portion 41. Herein, when the filter 4 is installed reversely, the positioning effect also can be achieved by the match of the second positioning portion 41' and first positioning portion 313. In other words, by the second positioning portions 41 and 41' disposed on the double sides of the filter 4 respectively, the filter 4 can be installed to the main body 31 in an observe or reverse manner. Therefore, the double-sided installation can be achieved to assist the user in replacing the filter 4.

Figure 5:
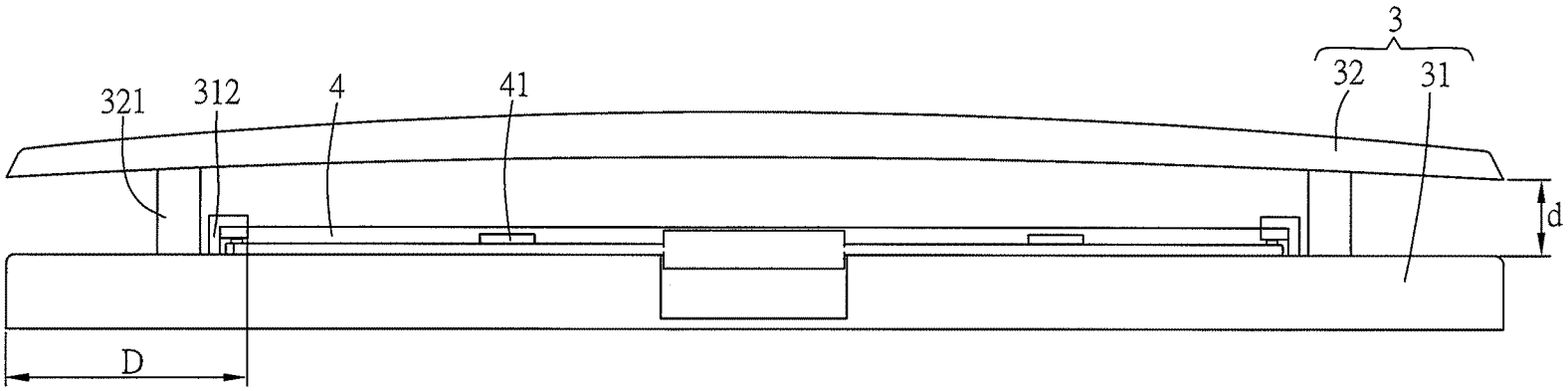
FIG. 5 is a schematic side view of structure in FIG. 2A along the X direction.

FIG. 5 is a schematic side view of structure in FIG. 2A along the X direction. As shown in FIGS. 2B, 4C, 5, the main body 31 includes a plurality of fixing portions 314 disposed on the main body 31. The cover 32 includes a plurality of connecting portions 321 connected to the fixing portions 314 correspondingly. In this embodiment, the connecting portions 321 are extended from the inner side of the cover 32 to the main body 31 and disposed corresponding to the fixing portions 314. The connecting portion 321 and the fixing portion 314 can be a tenon-type structure so that the cover 32 and the main body 31 can be disassembled, or the screws can be used to fix the connecting portions 321 and the fixing portions 314, as long as the main body 31 and the cover 32 can be securely connected to each other. Herein, the main body 31 and the cover 32 are disposed separately to form the gap 33, which is suitable for the side suction of the air. The distance d of the gap is favorably between 5 mm and 30 mm and is 14 mm more favorably.

Figure 6A:
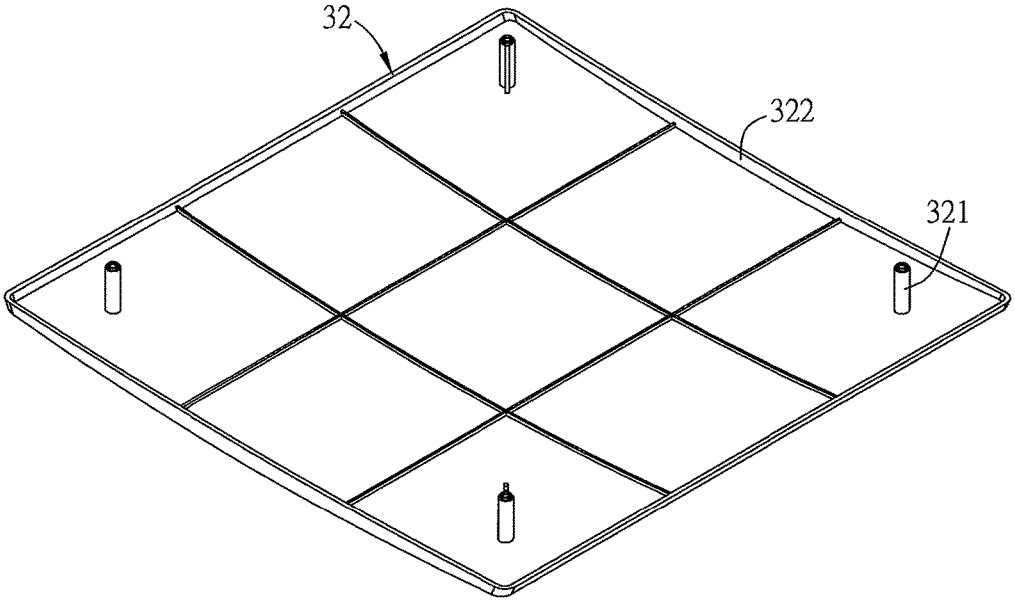
FIGS. 6A and 6B are schematic diagrams of the cover facing the inlet.
Figure 6B:
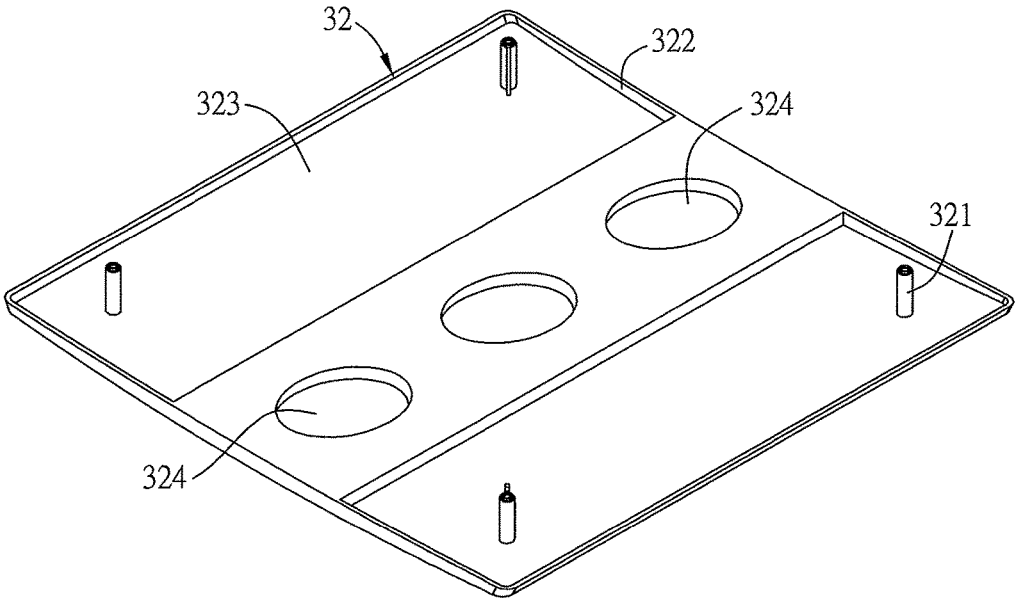

FIGS. 6A and 6B are schematic diagrams of the cover 32 facing the inlet. As shown in FIG. 6A, the cover 32 can further include a blocking wall 322 disposed around the surface of the cover 32 facing the main body 1. Therefore, the blocking wall 322 and the cover 32 form an accommodating space. In practice, when the ventilation fan 1 is installed to the ceiling at the bathroom, the damp caused by the shower is easily condensed into water during the operation of the ventilation fan 1. When the damp is condensed into water and drops to the cover 32, the blocking wall 322 will prevent the water from dropping or flowing to the user. In this embodiment, as shown in FIG. 4C, the average height h of the blocking wall 322 is greater than 2 mm favorably. In this embodiment, the inner surface of the cover 32 is curved so as to increase the above-mentioned accommodating space. Certainly, in other embodiments, the plane surface may be used to match the blocking wall 322 to form the accommodating space. However, this invention is not limited thereto. Moreover, in other embodiments, as shown in FIG. 6B, the above-mentioned accommodating space also can be formed by a plurality of depressions 323 or blind holes 324 to gather water drops. Besides, the blocking wall 322 also can be applied to prevent the water drops formed by the damp from falling to the user.

As shown in FIG. 1B, the main body 31 is connected to the fan 2 through at least a fixing element F. The fixing element F can be a screw to screw the main body 31 to the fan 2. Otherwise, the main body 31 and the fan 2 also can be connected together by an engaging or locking method or by an elastic element. In this embodiment, two fixing elements F are used and they are elastic elements for example. The elastic element is roughly a V-shaped metal element, and the bending portion thereof is connected to the main body 31. Besides, the two ends of the elastic element both have a hook structure F1. Herein, when the cover module 3 is installed to the fan 2, the elastic elements are disposed to pass through the fan 2 and the hook structures F1 will be fixed to the fan 2. In practice, due to the design of the elastic element, the cover module 3 will be suspended in the air during the disassembly of the cover module 3 because the hook structures F1 are still stuck by the fan 2. Then, the user can just press the elastic elements if needing to dismount the cover module 3.

Because the ventilation fan 2 is designed to have a side suction of the air, the air will flow to the filter 4 and the inlet 21 through the gap 33 and then flow out through the outlet 22. Accordingly, the dust will be accumulated on the filter 4 and the user will not see the accumulation of the dust. Therefore, a beautiful look can be provided. Besides, the cover 32 can be designed with a curve surface or plane surface for example. However, this invention is not limited thereto.

In this embodiment, the material of the filter 4 has an effective filter area of 42%, an air permeability greater than 4196×10−3 $m^3/m^2$*sec and a dust containing capacity of 92.6 $g/m^2$, so that it can effectively filter out the dust while providing the ventilation.

Since the cover 32 is without the inlet, the air will flow to the fan 2 through the gap 33. Therefore, in comparison with the conventional art where the front side of the cover has an inlet, the cover 32 of this embodiment is more effective against the noise. Herein, when the ventilation fan 1 works, the effect of resisting the noise can be enhanced in comparison with the conventional cover of the ventilation fan.

Besides, because the cover 32 of this embodiment is without the inlet at the front side, the function of water repellency can be provided. For example, when the ventilation fan 1 is installed in the bathroom and the shower water accidentally splashes onto the ventilation fan 1, the cover 32 can prevent the water from directly entering the fan 2 so as to avoid the damage to the motor. To be noted, in this embodiment, the average distance D from the projection location of the edge of the cover 32 on the main body 31 to the opening 311 is favorably greater than or equal to the distance d of the gap, as shown in FIGS. 4C and 5, so as to prevent a larger-angle water splash.

Summarily, the ventilation fan of this invention can provide the ventilation for the room, and the cover and the main body are separately disposed to form the gap for the side suction of the air. Accordingly, the air will flow to the filter and inlet through the gap and then flow out of the outlet through the fan, so that the dust won't be accumulated on the cover. Besides, due to the detachable design of the filter and cover module, the user can replace the filter without additionally opening the cover, so that the clean operation for the filter becomes easier and more convenient.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A ventilation fan installed to a ceiling comprising:
a fan including an inlet and an outlet;
a cover module disposed at the inlet and including:
a main body disposed at the inlet and including:
an opening disposed corresponding to the inlet, wherein the periphery of the opening is configured with two opposite slideways; and
a plurality of fixing portions having a tenon-type structure and disposed on the main body; and
a cover including a plurality of connecting portions and a blocking wall, wherein the cover and the main body are disposed separately, a gap for side suction of air is formed between an edge of the cover and an edge of the main body, the plurality of connecting portions have a tenon-type structure and are correspondingly connected to the plurality of fixing portions, and the blocking wall is disposed around a surface of the cover facing the main body so as to prevent water from dropping or flowing when the ventilation fan is installed to the ceiling; and
a filter having a capability to slide on the slideways and be detached to be disposed at the opening;
wherein an area of the cover is larger than that of the opening, and air flows to the filter and the inlet through the gap and then flows out of the outlet through the fan, the cover and the main body are fixed parallel to each other by the tenon-type structure to form the gap, such that four sides of the cover module have a side suction entry communicating with an outside, an airflow direction of an airflow from the outside through the side suction entry is perpendicular to a normal direction of the opening of the main body, the filter is slidably disposed between and parallel to the cover and the main body.

2. The ventilation fan as recited in claim 1, wherein the width of the gap is between 5 mm and 30 mm.

3. The ventilation fan as recited in claim 1, wherein a height of the blocking wall is greater than 2 mm.

4. The ventilation fan as recited in claim 1, wherein the cover further includes a plurality of depressions and/or blind holes which are disposed on the surface of the cover facing the main body.

5. The ventilation fan as recited in claim 1, wherein an average distance from a projection location of the edge of the cover on the main body to the opening is greater than or equal to a width of the gap.

6. The ventilation fan as recited in claim 1, wherein the main body includes at least a first positioning portion and the filter includes at least a second positioning portion, and the first positioning portion and the second positioning portion are engaged with each other, wherein the first positioning portion is an opening or hole, and the second positioning portion is a protrusion.

7. The ventilation fan as recited in claim 6, wherein the filter includes two second positioning portions which are disposed on two sides of the filter respectively.

8. The ventilation fan as recited in claim 1, which further comprises:
at least a screw, wherein the cover module is connected to the fan by the screw.

9. The ventilation fan as recited in claim 1, which further comprises:
at least an elastic element, wherein the cover module is connected to the fan by the elastic element.

10. A ventilation fan installed to a ceiling, comprising:
a fan including an inlet and an outlet;
a cover module disposed at the inlet and including:
a main body disposed at the inlet and including:
an opening disposed corresponding to the inlet, wherein the periphery of the opening is configured with two opposite slideways; and
a plurality of fixing portions having a tenon-type structure and disposed on the main body; and
a cover, wherein the cover and the main body are disposed separately, a gap for side suction of air is formed between an edge of the cover and an edge of the main body and the cover includes a plurality of connecting portions having a tenon-type structure and correspondingly connected to the plurality of fixing portions; and a filter having a capability to slide on the slideways and be detached to be disposed at the opening;

wherein the main body further includes at least a first positioning portion on a surface of the main body facing the filter, the filter includes at least a second positioning portion on a surface of the filter facing the main body, the first positioning portion and the second positioning portion are engaged with each other, the first positioning portion is an opening or hole, and the second positioning portion is a protrusion, wherein an area of the cover is larger than that of the opening, and air flows to the filter and the inlet through the gap and then flows out of the outlet through the fan, the cover and the main body are fixed parallel to each other by the tenon-type structure to form the gap, such that four sides of the cover module have a side suction entry communicating with an outside, an airflow direction of an airflow from the outside through the side suction entry is perpendicular to a normal direction of the opening of the main body, and the filter is slidably disposed between and parallel to the cover and the main body.

11. The ventilation fan as recited in claim 10, wherein the width of the gap is between 5 mm and 30 mm.

12. The ventilation fan as recited in claim 10, wherein the cover further includes a blocking wall disposed around a surface of the cover facing the main body.

13. The ventilation fan as recited in claim 12, wherein a height of the blocking wall is greater than 2 mm.

14. The ventilation fan as recited in claim 10, wherein the cover further includes a plurality of depressions and/or blind holes which are disposed on a surface of the cover facing the main body.

15. The ventilation fan as recited in claim 10, wherein an average distance from a projection location of the edge of the cover on the main body to the opening is greater than or equal to a width of the gap.

16. The ventilation fan as recited in claim 10, wherein the filter includes two second positioning portions which are disposed on two sides of the filter respectively.

17. The ventilation fan as recited in claim 10, which further comprises:

at least a screw, wherein the cover module is connected to the fan by the screw.

18. The ventilation fan as recited in claim 10, which further comprises:

at least an elastic element, wherein the cover module is connected to the fan by the elastic element.

* * * * *